US006416165B1

(12) United States Patent
Meyer et al.

(10) Patent No.: US 6,416,165 B1
(45) Date of Patent: Jul. 9, 2002

(54) PRINTHEAD ASSEMBLY AND METHOD OF USING SAME

(75) Inventors: John F. Meyer; Dennis Sonnenburg, both of San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/571,646

(22) Filed: May 15, 2000

(51) Int. Cl.[7] ..... B41J 2/01

(52) U.S. Cl. ..... 347/49

(58) Field of Search ..... 347/37, 40, 43, 347/49

(56) References Cited

U.S. PATENT DOCUMENTS 6,065,826 A * 5/2000 Robinson et al. ..... 347/49
6,227,649 B1 * 5/2001 Hirabayashi et al. ..... 347/40

* cited by examiner

*Primary Examiner*—Michael Nghiem

(57) ABSTRACT

An ink-jet printhead assembly including an elongated printhead carriage for supporting a plurality of printheads for movement across a path of travel of print media. The carriage includes a pair of ends and a region disposed equidistant the ends. The carriage supports a pair of staggered printhead arrays and each one of the pair of printhead arrays includes a plurality of spaced apart printheads. At least two of the plurality of printheads have an orifice plate having an edge disposed adjacent the central region, wherein the centrally disposed edge of each one of the orifice plates is collinear with an edge of each of the other centrally disposed orifice plates.

9 Claims, 3 Drawing Sheets

PRINTHEAD ASSEMBLY AND METHOD OF USING SAME

BACKGROUND OF THE INVENTION

The present invention relates generally to ink-jet printers and, more particularly, to a printhead assembly for use in such printers, and the method of using the same.

Modern printing devices utilize a printhead or drop ejector mounted in a carriage that is moved back and forth across print media, such as paper for example. As the printhead moves across the print media, a control system activates the printhead to deposit or eject ink droplets onto the print media to form images and text.

While such conventional printing devices have substantial value and are useful in many applications, in some cases conventional printers have serious limitations. For example, a requirement exists for increasing the throughput, or output rate, of inkjet printers for commercial applications. These applications include document copying, print on demand, and document customization. As a general rule, such applications require rapid generation of printed documents, without sacrificing print quality.

While recognizing the limitations of conventional in satisfying high speed printing requirements, printer designers have considered several approaches. One approach is to develop a new printhead with an increased firing frequency. Such a printhead would, no doubt, have great value. However, the costs of research, development and manufacture of such a printhead, and inks compatible therewith, render this solution unacceptable for current requirements.

Since getting the ink onto the media rapidly is a design objective, another conventional solution to the high speed/high print quality goal is to increase the number of printheads supported by the printhead carriage. In general, the printhead surface facing the media is substantially rectangular and elongated, having an orifice plate located adjacent an end of the facing surface. One conventional solution to the problem has been to deploy 8 to 12 printheads, arrayed in two parallel rows, wherein the print media travels perpendicularly to the row axes.

While this approach can increase printer throughput, it often does so at the expense of print quality. This is the case because, no matter how close together the parallel printhead rows are, there will still be a distance between opposing printhead orifice plates. As a result, as the media travels past the parallel rows, there will be a time when no printing is occurring. This presents two problems when paper is the print media.

It is recognized that paper tends to cockle, or swell up, as it is whetted during the printing process. The cockle problem presents the printer designer with a formidable problem. Simply put, while trying to increase throughput by placing multiple printheads in parallel rows, the time when printing is not occurring increases the likelihood of cockling of the paper. In addition, the dwell time, or print delay in the parallel row design, sometimes results in ink and media interactions. This is an undesirable outcome since it can produce hue shift, resulting in banding on the printed media.

In view of the problems inherent in the parallel printhead row design, another approach has been tried. In this case, multiple printheads have been arrayed in a pair of staggered rows with the objective of keeping ink on the media at all times during the printing process. This concept has value since it lessens substantially the hue shift problem. A shortcoming, however, is that this design requires a long media print zone and it is necessary to hold the media flat for an extended period of time. The long print zone, of course, tends to exacerbate the cockling problem.

From the foregoing it will be apparent that conventional solutions to the high throughput and high print quality challenge are not satisfactory. Thus, there is a need for a printing technique whereby this challenge is met without expenditure of money and effort to design a new printhead. Desirably, such a technique would afford increased throughput while enabling a high level of print quality while avoiding the limitations of hue shift and media cockle.

DISCLOSURE OF THE INVENTION

According to the present invention, there is provided an ink-jet printhead assembly comprising an elongated printhead carriage for supporting a plurality of printheads for movement across a path of travel of print media. The carriage includes a pair of ends and a region disposed equidistant the ends. The carriage supports a pair of staggered printhead arrays and each one of the pair of printhead arrays includes a plurality of spaced apart printheads. At least two of the plurality of printheads have an orifice plate having an edge disposed adjacent the central region, wherein the centrally disposed edge of each one of the orifice plates is collinear with an edge of each of the other centrally disposed orifice plates.

The present invention affords several advantages. It effectively doubles throughput, in pages per minute, over the conventional 4 printhead carriage array. Thus, without the costs and effort for new development in increasing firing frequency of a new printhead, existing printheads can be used in the invention to deliver increased throughput. Further, expensive ink and printhead development costs are avoided since existing printheads can be utilized.

Another advantage of the present invention is its inherent compatibility with existing writing system processes such as data pipeline, printhead servicing and print modes.

Further, printhead reliability and life issues are well known, in contrast to the situation wherein a new printhead would be employed. Printhead carriage design is simplified since such design can be leverage because of familiarity with the printhead. Finally, the time to market of the present invention is substantially shortened because of the elimination of a new printhead development program.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
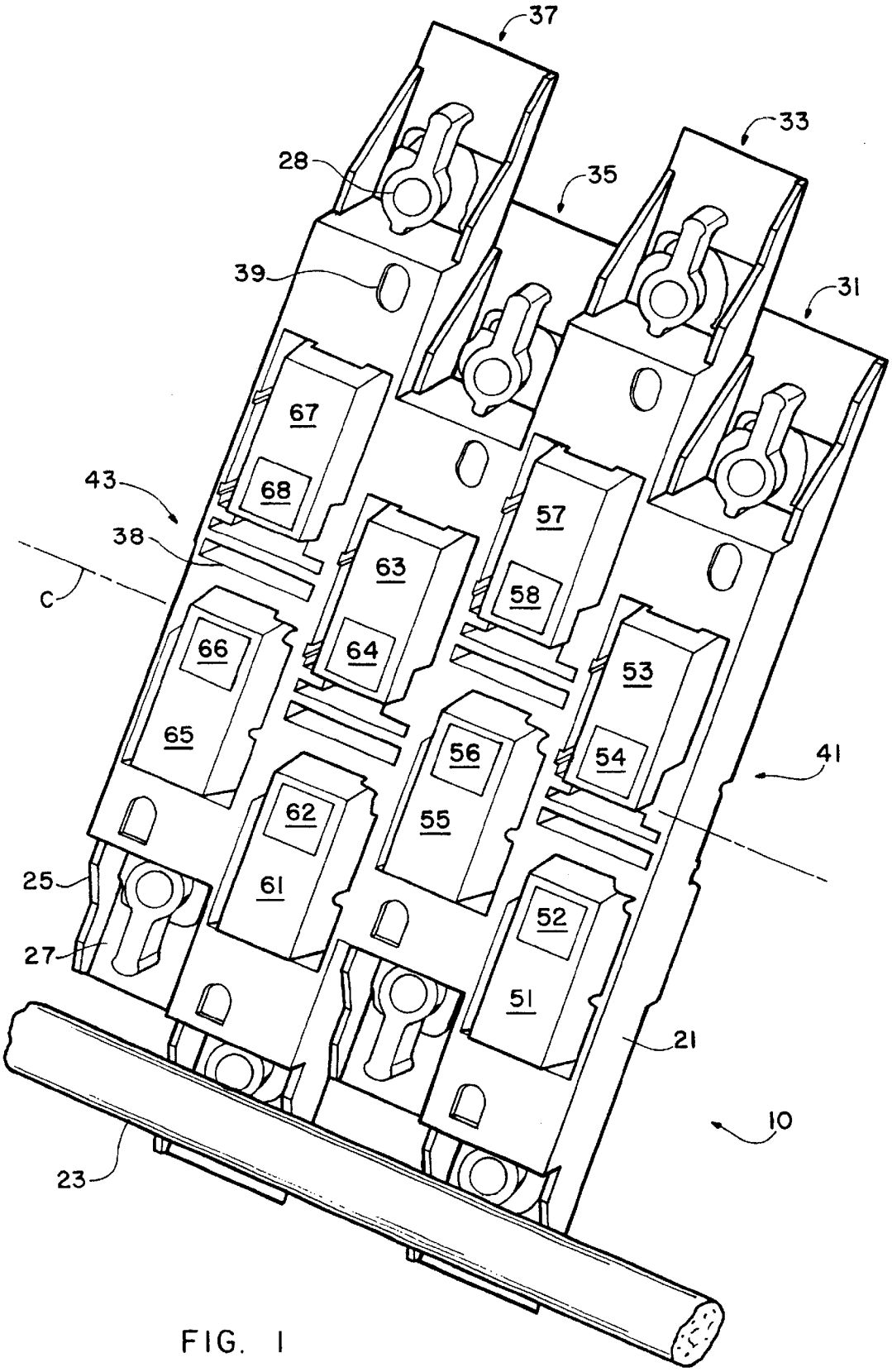
FIG. 1 is a perspective view of a printhead array that is constructed according to the present invention depicting a pair of staggered printhead arrays supported by a printhead carriage.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

In the following detailed description and in the figures of the drawings, like elements are identified with like reference numerals.

In a presently preferred embodiment of the invention, there is provided an ink-jet printhead assembly including an elongated printhead carriage for supporting a plurality of printheads for movement across a path of travel of print media. The carriage includes a pair of ends and a region disposed equidistant the ends. The carriage supports a pair of staggered printhead arrays and each one of the pair of printhead arrays includes a plurality of spaced apart printheads. At least two of the plurality of printheads have an orifice plate having an edge disposed adjacent the central region, wherein the centrally disposed edge of each one of the orifice plates is collinear with an edge of each of the other centrally disposed orifice plates.

Figure 2:
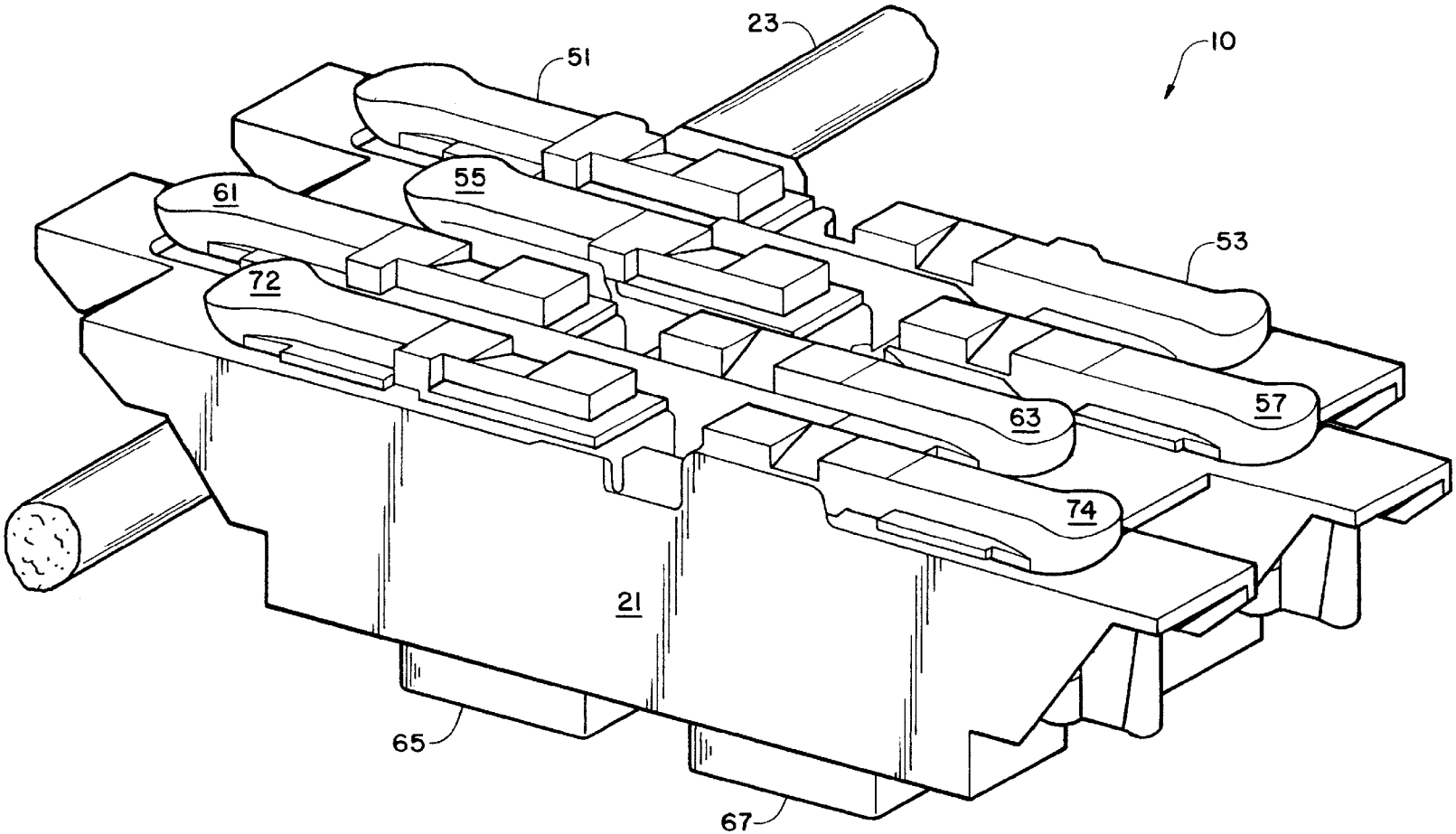
FIG. 2 is a perspective view of the opposite side of the printhead array shown in FIG. 1.

Referring now to the drawings and, in particular, to FIGS. 1 and 2 thereof, there is shown an ink-jet printhead assembly 10 that is constructed according to the present invention. The assembly 10 includes an elongated printhead carriage 21, movable along a rod 23 during print operations. The carriage supports a plurality of ink-jet printheads, such as the printheads 51, 53, 55, 57, 61, 63, 65 and 67. Each printhead is nested securely in a stall such as the stall 27, which is defined laterally by a sidewalk 25. As shown in FIG. 1, for example, the printhead 65 is located within the stall 27. Alignment/registration datum, such as the datum 39, aid a user in the process of installing the printheads, such as the printhead 67, in the carriage 21.

Each printhead has an associated fluidity interconnect, such as the interconnect 28, for supplying ink to a respective printhead, such as the printhead 67. In addition, each printhead has an associated electrical interconnect, such as the interconnect 38, whereby the individual printhead such as the printhead 67 is electrically coupled to printer electronics (not shown).

As best shown in FIG. 1, the printhead array 10 includes a pair of parallel rows, indicated generally by the reference numerals 41 and 43. Each one of the rows, e.g. may include four printheads. Each one of the rows 31, 33, 35 and 37 is parallel to the other rows and the rows are coaxial with the long axis of the elongated carriage 21. In a preferred embodiment of the invention, the printheads of a given row ejects ink having a color different from the color of ink ejected by the printheads of another row. Thus, for example, the printheads of the row 31 eject black ink, those of the row 33 eject yellow ink, the printheads of the row 35 eject ink of a magenta color and the printheads of the row 37 eject cyan ink.

As shown in FIG. 1, each of the printheads includes a generally rectangular top surface that is elongated and having a long axis parallel to the long axis of the carriage 21. Each one of the printheads includes a generally rectangularly shaped orifice plate whereby the printheads 51, 53, 55, 57, 61, 63, 65 and 67 include, respectively, the orifice plates 52, 54, 56, 58, 62, 64, 66 and 68. An imaginary center line C, equidistant from the ends of the carriage 21, divides the carriage 21 into two symmetrical halves. Each printhead orifice plate is located eccentrically, with respect to the top surface of its respective printhead, so that the orifice plate, in each case, is located adjacent the end of the printhead that is nearer than its opposite end to the center line C. By thus locating the printhead orifice plates, the orifice nozzle arrays are aligned along the center line C with no gap or overlap. That is, the edges of the orifice plates 54, 56, 64 and 66 are collinear along the center line C. The result is a substantially narrowed print zone which, in turn, results in a substantial elimination of the cockling problem while increasing throughput.

In addition to the advantages set forth above, the present invention affords a simplified technique for managing ink supply to the printheads. FIG. 2 shows the top of the printheads of FIG. 1, as they are disposed on the opposite side of the carriage 21. Those skilled in the art will recognize that the compact distribution of printheads simplifies delivery of ink, and of electrical signals, to the printheads.

Figure 3:
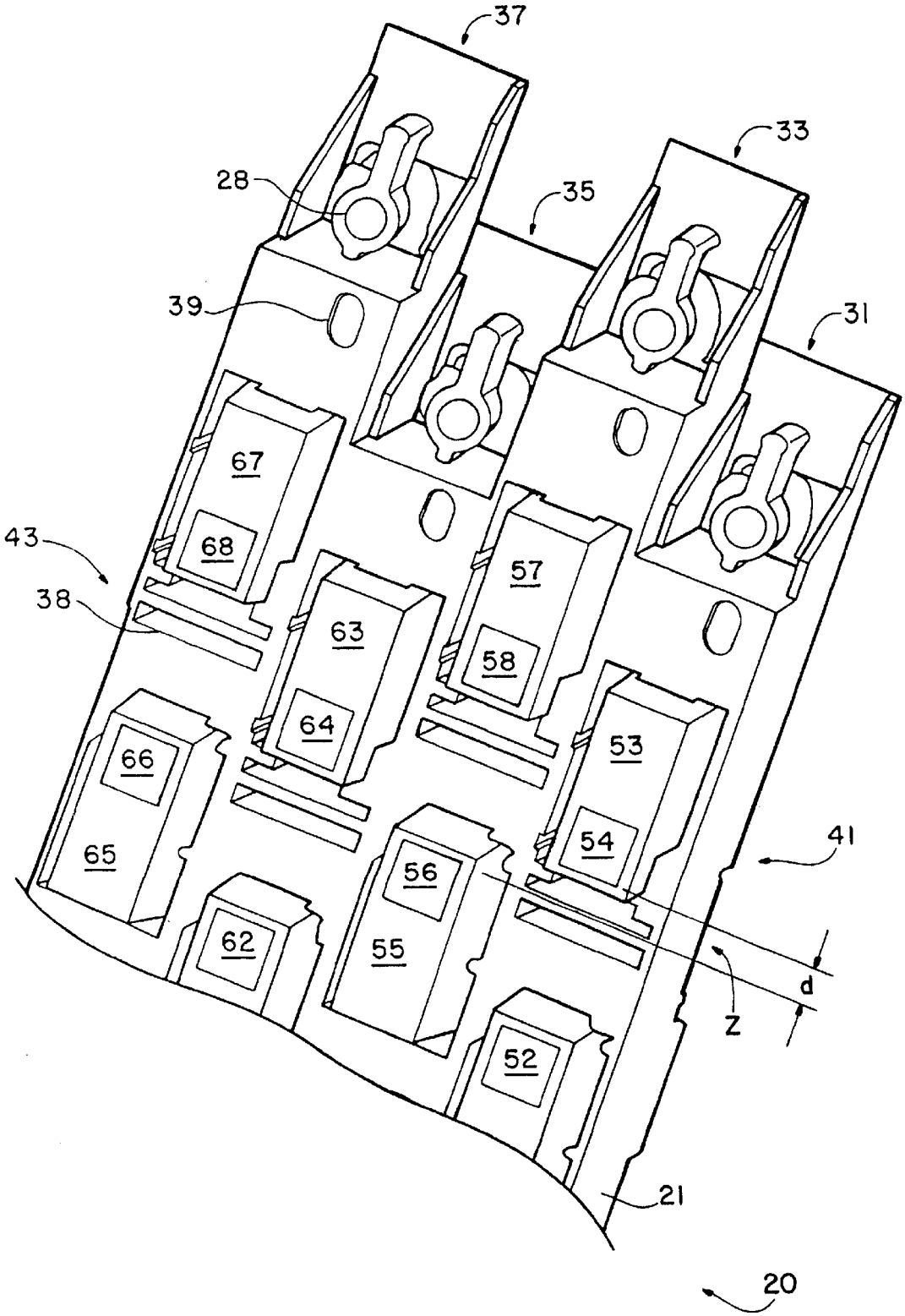
FIG. 3 is a partial perspective view of another embodiment of the printhead array of the present invention.

Referring now to FIG. 3, in which identical numerals represent identical elements, there is shown a second embodiment 20 of the printhead array of the present invention. The printhead array 20 is similar in structure and function to the array 10 except that the edges of the orifice plates 54, 56, 64 and 66 are not collinear but, instead, are separated to thereby define a narrow print zone Z. The width d of the print zone Z can vary from about 1/64 the inch to about ½ inch.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. An ink-jet assembly, comprising:

an elongated printhead carriage for supporting a plurality of printheads for movement across a path of travel of print media, said carriage having a pair of ends and a region located equidistant from said ends;

a pair of staggered printhead arrays, supported by said carriage, each one of said pair of printhead arrays including a plurality of spaced apart printheads, at least two of said plurality of printheads including an orifice plate having an edge disposed adjacent said region, wherein the edge of each one of said orifice plates disposed adjacent said region is collinear with an edge of each of the other orifice plates disposed adjacent said region and wherein each one of said printhead arrays includes a pair of parallel rows of printheads and each one of said parallel rows of printheads is parallel to the long axes of said carriage and to the rows of another one of said staggered printhead arrays, and each one of said parallel rows of printheads includes four printheads.

2. The ink-jet printhead assembly according to claim 1, wherein each one of the four printheads in a one of said parallel rows contains identically colored ink.

3. The ink-jet printhead assembly according to claim 1, wherein the ink contained in a printhead in one of the parallel rows has a color different from the ink contained in a printhead in another one of said parallel rows.

4. An inkjet assembly, comprising:

an elongated printhead carriage having a pair of ends and an imaginary center line disposed between said ends;

a pair of staggered printhead arrays, attached to said carriage, each one of said pair of printhead arrays including a plurality of printheads, each one of said printheads having an elongated surface and each one of said surfaces including an orifice plate disposed adjacent an end thereof, wherein the orifice plates of at least two printheads of each of said pair of printhead arrays are disposed adjacent said imaginary center line and wherein said imaginary center line is disposed generally perpendicularly to the long axis of said carriage and generally equidistant the ends thereof, each staggered printhead array including a pair of parallel rows of printheads, wherein each one of said parallel rows of printheads is parallel to the long axis of said carriage and to the rows of another one of said staggered printhead arrays and to each one of said parallel rows of printheads and wherein each one of said parallel rows includes four printheads.

5. The ink-jet printhead assembly according to claim 4, wherein each one of the four printheads in a one of said parallel rows contains identically colored ink.

6. The ink-jet printhead assembly according to claim 4, wherein the ink contained in a printhead in one of the parallel rows said has a color different from the ink contained in a printhead in another one of said parallel rows.

7. A method of printing images on print media, comprising:

providing an elongated printhead carriage for supporting a plurality of printheads for movement across a path of travel of said print media, said carriage including a pair of ends;

providing a pair of staggered printhead arrays, each one of said pair of printhead arrays including a plurality of printheads and each one of said printheads having an orifice plate, wherein each one of said printhead arrays includes a pair of parallel rows of printheads, each one of said rows including four printheads;

identifying a region on said carriage substantially equidistant from the ends thereof; and installing said pair of staggered printheads on said carriage whereby each one of the printhead orifice plates has an edge that is collinear with the edge of another orifice plate.

8. The method according to claim 7, wherein said installing step includes locating the collinear edges of said orifice plates equidistant from the ends of said carriage.

9. The method according to claim 7, wherein said installing step includes locating the collinear edges of said orifice plates in said central region.

* * * * *

UNITED STATES PATENT AND TRADEMARK OFFICE

CERTIFICATE OF CORRECTION

PATENT NO. : 6,416,165 B1
DATED : July 9, 2002
INVENTOR(S) : John F. Meyer et al.

It is certified that error appears in the above-identified patent and that said Letters Patent is hereby corrected as shown below:

Column 3,
Line 46, "e.g." should read -- e.g. 41 --;

Signed and Sealed this

Twenty-fifth Day of February, 2003

JAMES E. ROGAN
*Director of the United States Patent and Trademark Office*